US005180014A

United States Patent [19]

Cox

[11] Patent Number: 5,180,014

[45] Date of Patent: Jan. 19, 1993

[54] SYSTEM FOR DEPLOYING SUBMERSIBLE PUMP USING REELED TUBING

[75] Inventor: Don C. Cox, Roanoke, Tex.

[73] Assignee: Otis Engineering Corporation, Carrollton, Tex.

[21] Appl. No.: 655,086

[22] Filed: Feb. 14, 1991

[51] Int. Cl.[5] ..... E21B 19/00

[52] U.S. Cl. ..... 166/384; 166/385; 166/66.4; 166/68

[58] Field of Search ..... 166/385, 66.4, 65.1, 166/68, 380, 384

[56] References Cited

U.S. PATENT DOCUMENTS

| | | | |
|---|---|---|---|
| 3,401,749 | 9/1968 | Daniel | 166/46 |
| 3,835,929 | 9/1974 | Suman | 166/75.1 X |
| 4,440,221 | 4/1984 | Taylor et al. | 166/106 |
| 4,478,278 | 10/1984 | Klein | 166/65.1 X |
| 4,553,590 | 11/1985 | Phillips | 166/68 X |
| 4,589,482 | 5/1986 | Bayh, III | 166/105.5 |
| 4,682,657 | 7/1987 | Crawford | 166/385 |
| 4,830,113 | 5/1989 | Geyer | 166/369 |
| 4,913,239 | 4/1990 | Bayh, III | 166/385 |
| 4,938,060 | 7/1990 | Sizer et al. . | |

FOREIGN PATENT DOCUMENTS 2234279 1/1991 United Kingdom .

OTHER PUBLICATIONS

Robison, C. E. and Cox, D. C., Alternate Methods for Installing ESP's, Offshore Technology Conf., Houston, May, 1992.

"The Coiled Tubing Boom", *Petroleum Engineer International*, Apr. 1991, pp. 16, 17, 18 and 20.

*Primary Examiner*—Ramon S. Britts
*Assistant Examiner*—Roger J. Schoeppel
*Attorney, Agent, or Firm*—Ross, Howison, Clapp and Korn

[57] ABSTRACT

A method and system for deploying electric submersible pumps in oil wells using reeled tubing, comprising providing reeled tubing (10), providing an electric submersible pump (20) and connecting it to one end of the reeled tubing (10), providing electric cable (22) and connecting one end of it to the electric submersible pump (20), aligning the electric cable (22) with the reeled tubing (10), using clamps (28) to attach the electrical cable (22) to the reeled tubing (10), inserting the electric submersible pump (20) into a wellbore (18), and injecting sufficient reeled tubing (10) and electrical cable (22) into the wellbore (18) to lower the electric submersible pump (20) to a desired level.

6 Claims, 1 Drawing Sheet

SYSTEM FOR DEPLOYING SUBMERSIBLE PUMP USING REELED TUBING

BACKGROUND OF THE INVENTION

1. Field of the Invention

This invention relates to electric submersible pumps used in oil wells, and more particularly, to a method and system for deploying an electric submersible pump ("ESP") in an oil well using reeled or coiled tubing.

2. Prior Art

The use of electric submersible pumps in oil wells is known. In the past, such pumps have been installed in wells using strings of conventional threaded production tubing. Unfortunately, the service life of electric submersible pumps is frequently limited because of factors such as hostile well conditions, improper equipment selection and improper installation. Damage to the pump and/or electrical cable can also be caused by rough handling associated with use of the work-over rigs that are required to service equipment deployed on such tubing strings.

Another method for deploying some downhole equipment in oil wells is through the use of reeled or coil tubing. The use of coil tubing for deploying a downhole inspection system is disclosed, for example, in U.S. Pat. No. 4,938,060. The use of coil tubing for installing a jet pump through conventional threaded production tubing in stripper wells is disclosed in U.S. Pat. No. 4,664,603.

SUMMARY OF THE INVENTION

According to the present invention, a method is provided for installing an electric submersible pump in a well with reeled tubing instead of on a conventional threaded production string.

According to a preferred embodiment of the invention, the ESP is connected to the end of reeled tubing, and the reeled tubing is injected into the well at the wellhead using a conventional tubing injector. As the tubing is injected into the well, an electrical cable operatively connected to the ESP is dispensed from a second reel and is clamped or otherwise joined to the tubing at desired intervals. Clamping the electrical cable to the reeled tubing in this manner causes a significant portion of the weight of the electrical cable to be supported by the tubing. Otherwise, especially in deeper wells, the tensile strength of the electrical cable might not be adequate to support the cable weight.

Using the method and system of the invention, liquid hydrocarbons are produced through the reeled tubing.

BRIEF DESCRIPTION OF THE DRAWING

The method of the invention is further described and explained in relation to FIG. 1, which is a simplified elevational view, partially in section, showing an electric submersible pump deployed in a wellbore with reeled tubing having an electrical cable clamped to it.

DESCRIPTION OF THE PREFERRED EMBODIMENTS

Figure 1:
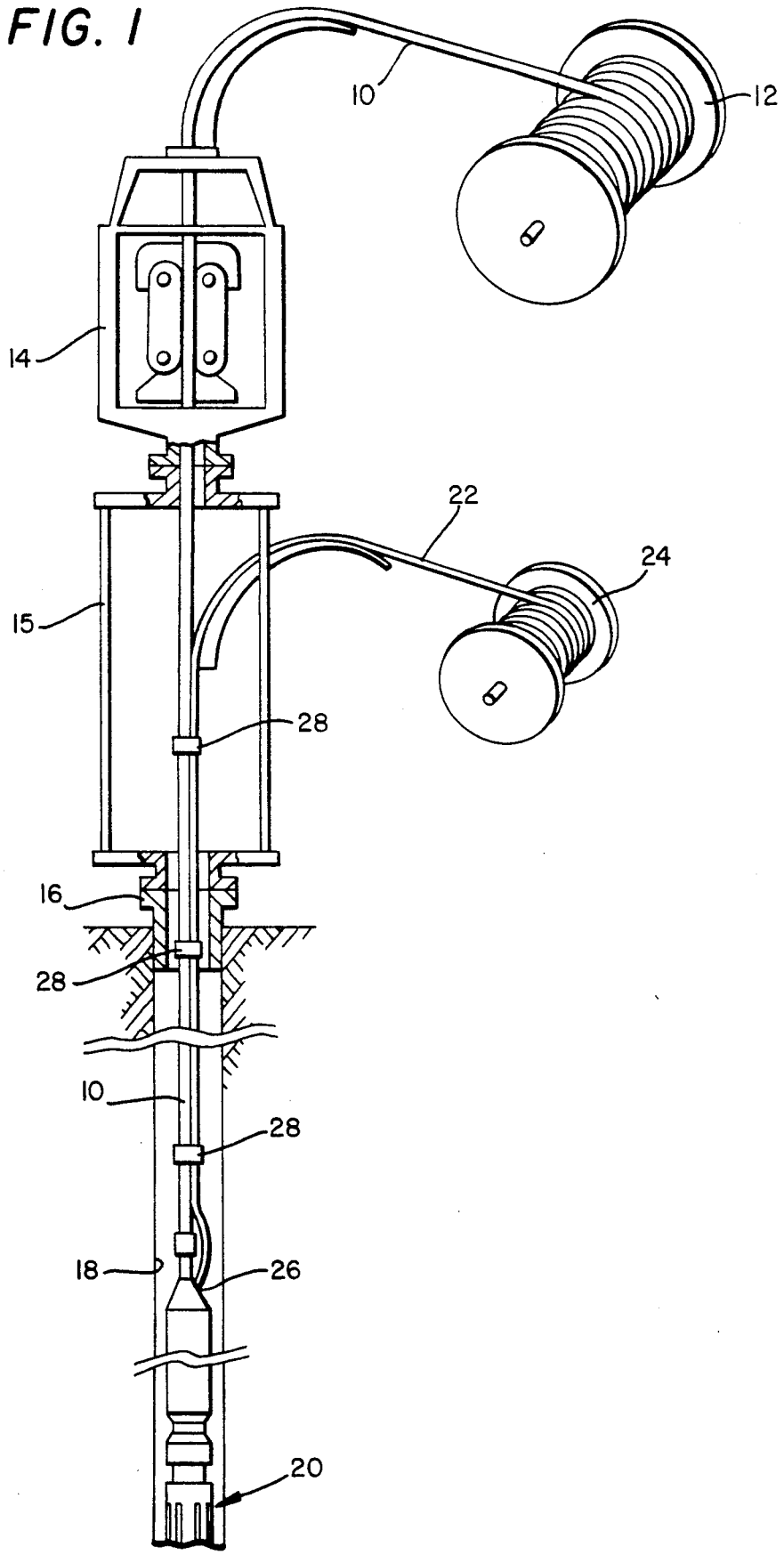

Referring to FIG. 1, reeled or coil tubing 10 is provided from reel 12 and injected through wellhead 16 into wellbore 18 using tubing injector 14. One end of reeled tubing 10 is operatively coupled to electric submersible pump 20 using a commercially available tubing connector. Such connectors are disclosed, for example, in U.S. Pat. Nos. 3,401,759; 3,689,111; and 4,682,657.

One end of electrical cable 22 is likewise operatively connected to electric submersible pump 20, and electric submersible pump 20 is then inserted into wellbore 18.

Reeled tubing 10 used in the present invention preferably has an outside diameter of about 2 inches or larger, and is continuously rolled or formed into a cylinder and welded along a longitudinal seam from steel strip stock by conventional methods. Nine gauge strip having a thickness of about 0.148 inches is preferred for reeled tubing used to deploy electric submersible pumps in accordance with the method of the invention. Although FIG. 1 is simplified for purposes of illustration herein, it is understood that reel 12 is typically mounted on a truck or trailer as depicted, for example, in FIG. 1 of U.S. Pat. No. 4,938,060.

Tubing injector 14 is desirably mounted over window 15 or a tubing hanger at wellhead 16 to permit electric cable 22 to be brought into substantially parallel alignment with reeled tubing 10 as electrical cable 22 is supplied from reel 24, also depicted in FIG. 1 in simplified form. The end of electrical cable 22 that extends into wellbore 18 is operatively connected to ESP 20 at point 26.

According to the method of the invention, electrical cable 22 is preferably secured to reeled tubing 10 by means such as clamps 28 at longitudinally spaced intervals. By clamping electrical cable 22 to reeled tubing 10 as shown, a significant part of the weight of electrical cable 22 is transferred to reeled tubing 10, thereby reducing tensile loading that might otherwise cause cable failure, especially in deeper wells. According to a particularly preferred embodiment of the invention, electrical cable 22 is clamped to reeled tubing 10 by stainless steel clamps or bands at intervals of about 15 feet. Tubing injector 14 is then used to inject a sufficient length of reeled tubing 10 and electrical cable 22 into wellbore 18 to position electrical submersible pump 20 at the desired depth.

Once electric submersible pump 20 is lowered to the desired depth, reeled tubing 10 and electrical cable 22 can be severed from reels 12, 24, respectively, and connected to appropriate conventional operating equipment at the well surface. Various wellhead connections are commercially available for use with the invention disclosed herein. One such completion assembly, for example, is the TC Electro-Sub tubing hanger marketed by the Petroleum Equipment Group of FMC Corporation. This assembly, as shown on page 1470 of the 1988–89 Composite Catalog, Volume 2, provides an integral high-voltage conduit for use with submersible pumps or subsurface monitoring equipment. Once electrical power is supplied to submersible pump 20 through electrical cable 22, liquids disposed inside wellbore 18 will be pumped upwardly, desirably through reeled tubing 10, to the surface.

Through use of the invention disclosed herein, it is possible to install, operate and remove an electric submersible pump more efficiently and economically than has previously been possible using conventional methodology and systems requiring threaded production tubing, workover rigs, and the like.

While the method and system of the invention are disclosed herein in relation to the preferred embodiments, other alterations and modifications will become obvious to those of ordinary skill in the art upon reading this disclosure, and it is intended that the scope of the invention disclosed herein be limited only by the broadest interpretation of the appended claims to which the inventor is legally entitled.

I claim:

1. A method for deploying an electric submersible pump on reeled tubing in a subterranean wall, said method comprising the steps of:

providing reeled tubing;

providing an electric submersible pump; operatively connecting the electric submersible pump to the reeled tubing;

providing electrical cable;

operatively connecting one end of the electrical cable to the electric submersible pump;

aligning the electrical cable substantially parallel to the reeled tubing;

attaching the electrical cable to the outside of the reeled tubing at a plurality of longitudinally spaced locations;

inserting the electric submersible pump into a well bore; and injecting sufficient reeled tubing and electrical cable into the well bore to lower the electric submersible pump to a desired level.

2. The method of claim 1 wherein the electrical cable is attached to the reeled tubing by clamping.

3. A method for pumping liquids from a subterranean well, said method comprising the steps of:

providing reeled tubing;

providing an electric submersible pump;

operatively connecting the electric submersible pump to the reeled tubing;

providing electrical cable;

operatively connecting one end of the electrical cable to the electric submersible pump;

aligning the electrical cable substantially parallel to the reeled tubing;

attaching the electrical cable to the outside of the reeled tubing at a plurality of longitudinally spaced locations;

inserting the electric submersible pump into a wellbore; injecting sufficient reeled tubing and electrical cable into the wellbore to lower the electric submersible pump to a desired level; and supplying electrical power to the submersible electric pump through the electrical cable.

4. The method of claim 3 wherein the electrical cable is attached to the reeled tubing by clamping.

5. A system for use in pumping liquid hydrocarbons from a subterranean well, said system comprising:

reeled tubing;

an electric submersible pump;

means for operatively coupling the reeled tubing to the electric submersible pump;

electrical cable;

means for operatively coupling the electrical cable to the electric submersible pump;

means for aligning the electrical cable with the reeled tubing;

means for attaching the electrical cable to the outside of the reeled tubing; and means for injecting the electric submersible pump, reeled tubing and electrical cable to a desired depth in the well.

6. The system of claim 5 wherein the electrical cable is attached to the reeled tubing by clamping.

* * * * *